US006264508B1

(12) United States Patent
Lehmann

(10) Patent No.: US 6,264,508 B1
(45) Date of Patent: Jul. 24, 2001

(54) FEMALE TYPE CONTACT PIECE ENABLING ELECTRICAL CONTACT WITH A MALE ELEMENT

(75) Inventor: Pierre Lehmann, Courcelon (CH)

(73) Assignee: Preci-Dip Durtal SA, Delemont (CH)

( * ) Notice: Subject to any disclaimer, the term of this patent is extended or adjusted under 35 U.S.C. 154(b) by 0 days.

(21) Appl. No.: 09/499,638

(22) Filed: Feb. 8, 2000

(30) Foreign Application Priority Data

Nov. 30, 1999 (EP) ..... 99811102

(51) Int. Cl.[7] ..... H01R 13/187
(52) U.S. Cl. ..... 439/843
(58) Field of Search ..... 439/843, 844, 439/851, 852, 853, 854

(56) References Cited

U.S. PATENT DOCUMENTS

| | | | | |
|---|---|---|---|---|
| 2,689,337 | | 9/1954 | Burtt et al. . | |
| 3,564,487 | | 2/1971 | Upstone et al. . | |
| 4,461,530 | * | 7/1984 | Brush, Sr. et al. | 439/843 |
| 4,685,761 | * | 8/1987 | Locati | 439/843 |
| 5,322,459 | * | 6/1994 | Spinnato | 439/843 |
| 5,419,723 | | 5/1995 | Villiers et al. . | |
| 5,516,310 | | 5/1996 | Sawada . | |
| 5,897,404 | * | 4/1999 | Goodman et al. | 439/843 |

FOREIGN PATENT DOCUMENTS

| | | |
|---|---|---|
| 0 090 549 A2 | 10/1983 | (EP) . |
| 2 775 389 | 8/1999 | (FR) . |

* cited by examiner

*Primary Examiner*—Tulsidas Patel
*Assistant Examiner*—Brian S. Webb
(74) *Attorney, Agent, or Firm*—Oliff & Berridge, PLC

(57) ABSTRACT

The contact piece (1) comprises a portion of female type able to accommodate a corresponding portion of male type. This female type portion includes a contact clip (4) provided with elastic fingers (42) oriented towards the opening of a lodging (10) destined to accommodate said male type portion. The piece is completed with a bushing (5) encircling the clip and provided with a front side (50) comprising a passage opening (51) serving as gauge, accepting or refusing the passage of a male portion according to its diameter. In this manner, the elastic fingers (42) always operate in an elastic mode and never suffer a permanent deformation. Such a disposition has many other advantages.

20 Claims, 2 Drawing Sheets

FEMALE TYPE CONTACT PIECE ENABLING ELECTRICAL CONTACT WITH A MALE ELEMENT

The content of Application No 99811102.5, filed Nov. 30, 1999 in Europe, is hereby incorporated by reference.

BACKGROUND OF THE INVENTION

1. Field of the Invention

The present invention concerns a contact piece of the female type usable in a connector, for example a connector answering the MIL norm or any other specification, or for any other application, such as for example in an integrated circuit base, or destined to be placed on a printed circuit board. The invention concerns more particularly the portion of this contact piece destined to accommodate the corresponding element of the male type.

2. Description of the Related Art

Several specifications or norms, notably the MIL norms and in particular the MIL-C 39029 norm, define a certain number of characteristics which this portion of the contact piece must comply with, for example contact resistance, engagement and separation force of the male contact piece, depth of engagement of the male piece before contact is established etc. According to these norms, these various parameters are to be measured both when the pieces are new as well as after multiple uses, and this under very diverse environmental, temperature, humidity and other conditions.

In order to attempt to comply with these requirements, manufacturers have proposed various constructions of this portion of the contact piece.

Several known embodiments of such portions of contact pieces will be described further below, in connection with FIGS. 1A and 1B as well as FIG. 2 ; these embodiments encounter notably the following disadvantages according to the constructions described : need to work the entire contact piece in a costly metallic alloy since it must have excellent electrical conduction properties as well as excellent mechanical properties, notably spring power, need to heat treat at least several portions of the piece in order to give it the necessary mechanical characteristics, need to cover the whole piece, or an important portion thereof, with costly plating, of gold or silver, in order to give it the necessary electrical characteristics, difficulty to comply with certain norm requirements, notably MIL norms, lack of any possibility of interchanging the different elements of the contact piece, etc.

SUMMARY OF THE INVENTION

An object of the present invention is thus to propose a contact piece comprising notably a female portion destined to accommodate a corresponding male portion, of improved construction relatively to the known contact pieces, so as to avoid the aforementioned inconveniences of these contact pieces.

To achieve this object, a contact piece is proposed as described in the independent claim, particular embodiments or variants being described in the dependent claims. The last claims indicate more precisely some possible uses of such a contact piece.

BRIEF DESCRIPTION OF THE DRAWINGS

The invention will be described in detail below, this description, which further includes certain advantages of the invention, making reference to the attached drawing comprising the figures, in which.

DETAILED DESCRIPTION OF THE PREFERRED EMBODIMENTS

In the following description as well as in all the figures, only the female type portion of the contact piece 1, destined to accommodate a corresponding male type element, will be mentioned or represented. This male element is constituted of a pin, its mating end being hemispherical or shaped like a truncated cone, and having a determined diameter. This male element can be the male portion of a corresponding contact piece or else a pin of an integrated circuit or even a connecting part of an electronic component etc. The other portion of the contact piece 1, not described or represented here, can be of any known type for this kind of contact piece and can comprise for example a portion in which a wire can be crimped, screwed or soldered, or a fastening portion on a connector or printed circuit board or a second female type portion to constitute a transition contact piece, etc.

According to the simplest embodiment known, the portion of the contact piece which is of interest here is constituted of an axial bore of one of the contact piece's extremities, followed by the making of radial slits on a portion of the length of the tubular portion realized by the bore, so as to form elastic tongues or fingers. These fingers are then pressed together so as to form an elastic clamp. This construction has many inconveniences, namely a risk of permanent deformation of one or many of the fingers in the case of the askew engagement of a male element or the engagement of a male element of too big a diameter. Furthermore, although the contact piece is constituted of only one piece, it is costly as the necessary material must have the electrical and mechanical properties required for its functioning.

Figure 1B:
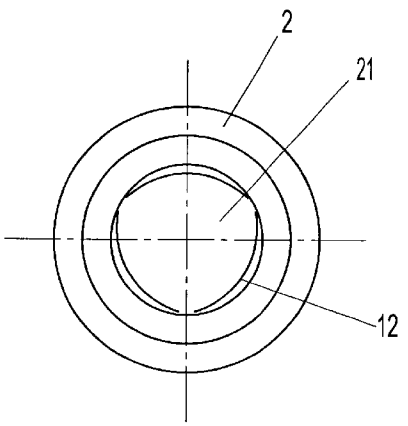
Fig. 1B (Related Art)
FIGS. 1A, 1B and 1C represent a portion of a contact piece according to a prior art construction, seen in partial longitudinal section, in elevational projection and in cross section, respectively.
Figure 1C:
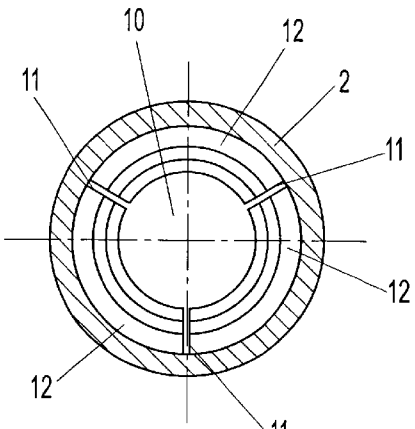
Fig. 1C (Related Art)
Figure 1A:
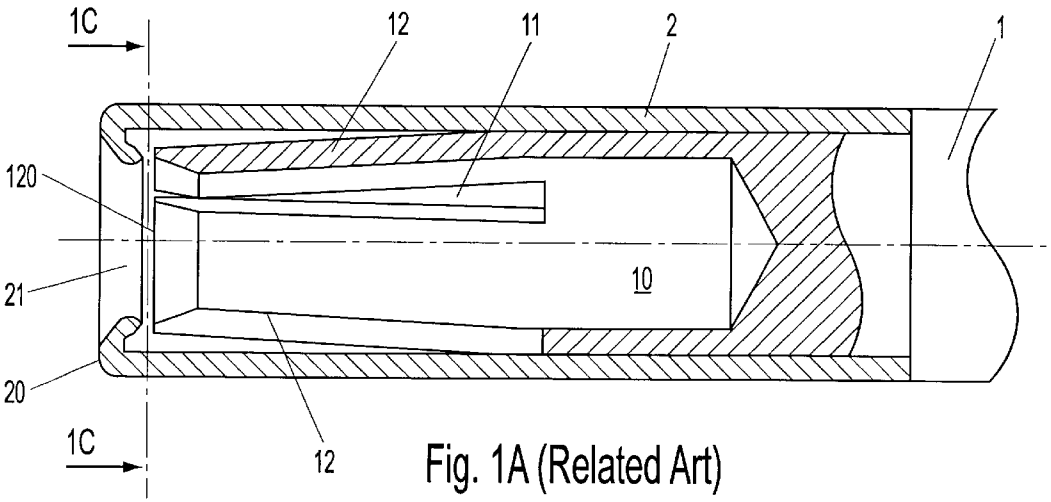
Fig. 1A (Related Art)

A first advantages modification made to the above contact piece includes in covering the portion in question with a bushing, as seen in FIGS. 1A, 1B and 1C. One can see in these figures the contact piece 1, constituted essentially of a metallic pin of which one end, visible in the figure, is destined to accommodate a male element, not visible in the figures. The other end of the contact piece, not visible in the figures, is worked in a conventional manner to fulfil any known function of such a contact piece. It can be seen that the portion of the contact piece 1 which is of interest here has been bored axially, so as to build a lodging 10 in which the male element will come to be lodged. Slits 11, three in the embodiment represented here, have been shaped in order to separate three fingers 12. The free extremities 120 of these three fingers 12 are then pressed together, by permanent deformation, so as to close slightly the clamp formed by the three fingers, as can be seen in the figures. As described so far, this construction represents the first embodiment described previously. In order to prevent too strong an opening movement of the fingers 12, this portion of the contact piece is provided with a tube-shaped bushing 2, affixed by crimping or any other means onto the portion of the contact piece 1 behind the fingers 12. This bushing 2 abuts against the external surfaces of the fingers 12, preventing these from being moved apart too much.

The extremity of bushing 2 facing the opening of lodging 10 comprises an end side 20 provided with a traversing opening 21 coaxial to the longitudinal axis of contact piece 1, respectively of lodging 10. The diameter of this opening 21 is determined so as to let pass only a male element of a diameter inferior to that of a male element which would flatten the fingers 12 against the bushing 2.

The opening 21, coaxial to the longitudinal axis of the lodging 10 further serves as guiding means of the male element when mating.

Although this latter construction limits the risk of deformation of the fingers 12 when a male element having too wide a diameter or being not aligned is engaged, the pressure applied by the bushing 2 on the fingers 12 when these are apart, notably on the rear portion of these fingers, means that the latter no longer work fully elastically, which in particular decreases the electric conducting qualities of the contact, notably in case of vibrations.

The inconvenience of machining the fingers 12 and the rest of the contact piece 1 from a single rough piece, i.e. of the same material, remains and results in a costly contact piece. For the same reasons, it is difficult and/or expensive to shape the extremities 120 of the fingers so that they become rounded for an easier mating of the male element; a slightly askew engagement of the male element relative to the longitudinal axis of the lodging 10 can result in the male element being brought to bear against the extremity 120 of a finger, leading this finger to be bent towards the inside of lodging 10, i.e. to the contact piece being destroyed.

Figure 2:
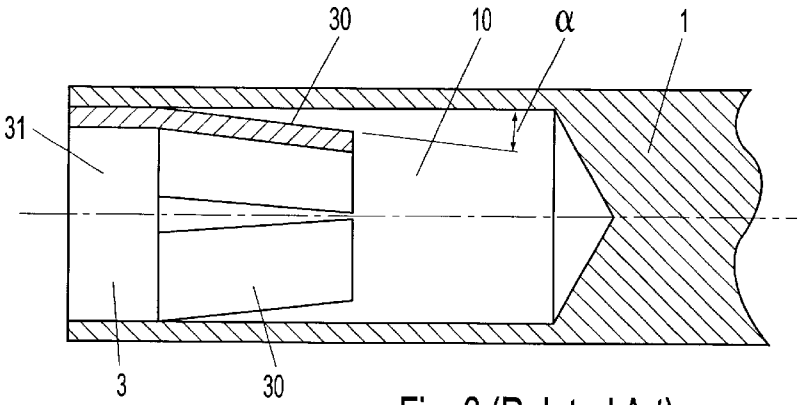
Fig. 2 (Related Art)
FIG. 2 represents a portion of a contact piece according to another prior art construction, seen in partial longitudinal section.

FIG. 2 shows a construction proposed to remedy these last flaws.

As previously, one has a contact piece 1 whose extremity that is of interest here is provided with an axial bore forming a lodging 10 for the male element to be accommodated. A contact clip 3 is inserted inside lodging 10. The contact clip 3 is formed from a metallic band, of a width corresponding to the length of the clip, which is embossed so as to form a lateral strip fitted with several fingers of an essentially trapezoidal shape, projecting on one of the sides of the lateral strip, the larger bases of each finger being adjacent to the lateral strip whereas the small bases are free. The strip is divided in portions, each comprising several trapezoidal fingers of the length of the portion corresponding to the interior perimeter of the lodging 10. The portion of strip is then coiled, the fingers being then pressed together by their extremities so as to deform them and decrease the inscribed diameter between the free extremities of the fingers. The clip 3 thus formed is inserted in the lodging 10, the free extremities of the fingers 30 being directed towards the bottom of lodging 10; the portion 31 of clip 3, formed by the aforementioned lateral strip, is maintained towards the open extremity of lodging 10 by any known means, insertion, crimping or other.

According to this construction, only clip 3 must be made of an alloy having excellent conductive qualities as well as excellent mechanical qualities of spring power. Therefore, the rest of contact piece 1 can be worked in a cheaper metal or alloy, for example brass. The clip 3 will be constituted preferably of a bronze/beryllium alloy or other.

During the mating of a male element, the fingers 30 move apart in order to clamp said male element. The moving apart of the fingers 30 is also restricted here by the inner surface of the lodging 10, with the same inconveniences as mentioned above.

Another inconvenience of this construction is that, in view of the low value of the angle $\alpha$ relative to the longitudinal axis formed by the fingers 30 pressed together, relative to the longitudinal axis of the lodging 10, the length at which it is necessary to engage the male element into the lodging 10 before its extremity comes into contact with the fingers 30 is important. Increasing this angle in order to diminish this distance could lead to the fingers 30 buttressing against the male element when the latter is withdrawn, thus causing it to be spoiled.

Figure 3B:
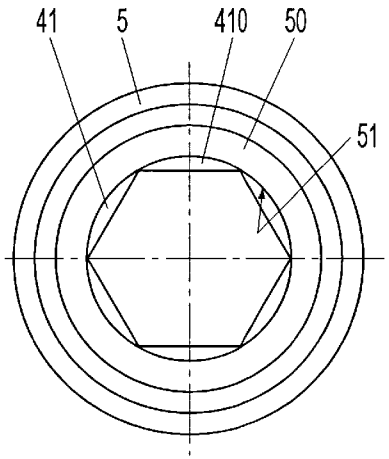
FIGS. 3A and 3B represent a portion of a contact piece according to a preferred embodiment of the invention, seen in partial longitudinal section and in elevational projection, respectively.
Figure 3A:
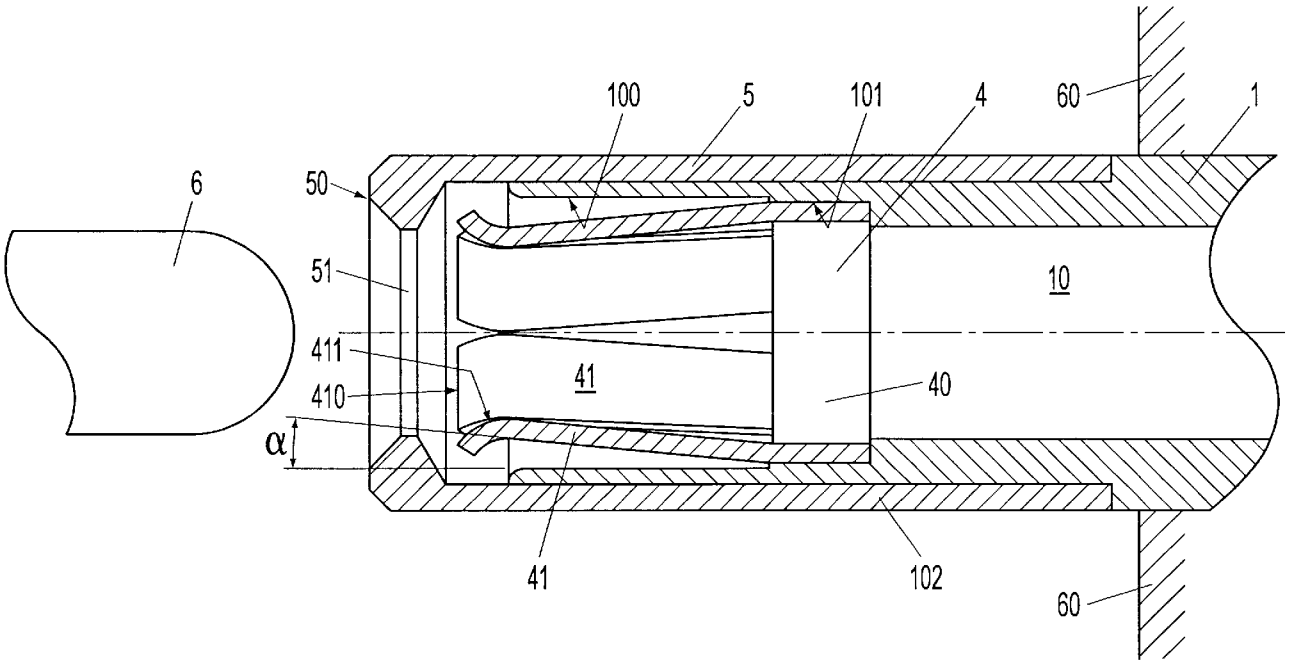

All the inconveniences mentioned previously in relation to the known constructions of the prior art are remedied by the construction according to the invention, of which a preferred embodiment is represented in FIGS. 3A and 3B. FIG. 3A shows a male element 6 for connection to the contact piece and a connector, component or printed circuit board 60 fitted to the contact piece.

As previously discussed, one has a contact piece 1 whose extremity destined to accommodate the male element 6 is bored longitudinally so as to form a lodging 10 for accommodating the male element. The open extremity of lodging 10 comprises a first inner cylindrical neck 100, whose interior diameter is superior to that of lodging 10, followed by a second inner cylindrical neck 101 whose inner diameter is comprised between that of neck 100 and that of the bottom of lodging 10.

A contact clip 4 is inserted by the open extremity of lodging 10, so that its cylindrical portion 40 comes to be positioned on the inner cylindrical neck 101.

The clip 4 is obtained preferably in a manner rather similar to that which has been described previously for clip 3. A complementary arching operation towards the outside of the fingers' extremities is conducted when the clips are always assembled in a continuous strip. As an alternative to the trapezoidally shaped lamellae described, one can also have lamellae of a rectangular shape and separation slits of a trapezoidal shape.

The clip 4 is fastened, by pressing in, crimping or any other known means on this inner neck 101. Unlike what has been described above in connection with clip 3, the contact fingers 41 of clip 4 have their free extremities 410 facing the opening of lodging 10. Furthermore, these free extremities 410, for each of the fingers 41, are formed so as to present an arched end portion 411, the free extremity directed towards the exterior being moved away from the longitudinal axis of lodging 10. This device is completed by an external bushing 5 pressed on and fastened on an outer cylindrical neck 102 of the contact piece 1. The extremity of bushing 5 facing the opening of lodging 10 comprises an end side 50 provided with a traversing opening 51 coaxial with the longitudinal axis of the contact piece 1, respectively of lodging 10. The diameter of this opening 51 is determined so as to let pass only a male element 6 of a diameter acceptable by the contact clip 4. It can further be seen in the figure that if a male element 6 has been engaged into clip 4, its diameter being lower than the diameter of opening 51, the moving apart of the fingers 41 of clip 4 is never restricted by the inner diameter of neck 100, since it is superior to that of neck 101, nor by the inner diameter of bushing 5, since it is greater than that of neck 101, nor by the inner diameter of bushing 5, since the latter is dimensioned so as to allow the fingers 41 to move away to a maximum. Thus, for a determined diameter, respectively gauge, of a male element 6 , the corresponding female contact piece comprises a contact clip 4 whose fingers 41 are subjected to an exclusively elastic deformation, on their whole length and on their whole range of deformation, the diameter limitation of the male element 6 being determined by the calibrated opening 51 of the bushing 5. This operating method in elastic mode ensures a maximum electrical conductivity of the contact, even in case of vibrations.

The angle α of each finger relative to the longitudinal axis is also small; this angle is typically comprised between 4° and 10°, being preferably comprised between 6° and 8°. In view of the arched portion 411 of the fingers 41, the male element cannot be buttressed when engaged or withdrawn from the fingers 41.

Another advantage of the presence of the arched portion is that the fingers 41 thus offer a greater contact surface with the male element, decreasing consequently the contact resistance between the female contact piece and the male contact piece.

Another advantage of this arched portion is a better transmission of the mechanical power between the male element and the clip, notably in the presence of vibrations. A spoiling of the contact surface of the male element in case of vibrations has namely been observed when the extremities of the contact fingers present an edge rather than a rounding as described for this embodiment.

Another advantage of this device is that the length of engagement of the male element before a contact is established is short since the male element meets first the portion of small diameter of the clip 4 formed by the fingers 41 pressed together.

Yet another advantage of this device is that the opening 51, aligned with the free extremities 410 of the fingers 41 forms a two point guiding means of the mating male element, thus preventing it from engaging askew.

The presence of the bushing 5 over the region of the contact piece 1 where the clip 4 is inserted and fastened ensures a mechanical reinforcement of the latter region by banding, respectively a better fastening of clip 4.

Tests have shown that when a male element mates with a female contact piece as represented in FIG. 2, either with a contact clip with the free extremities of the fingers facing the bottom of lodging 10, one has first a power peak as soon as the contact between the male element and the fingers is established, followed by an approximately constant force of lower value. On the other hand, when a male element engages in a contact piece according to the invention, one has a constant engagement force of low value, without the initial peak. The engaging movement of the male element in the female element is therefore much smoother, thus sparing the state of the male element's surface and reducing the risk of breakage of the male element, notably in the case of a pin of an integrated circuit which must be inserted into a base.

The separate manufacture of the clip and of the rest of the contact piece has many advantages, such as optimizing the choice of material for one or the other components according to the requirements, heat and/or surface treatment adapted for each element, separate management of the stocks of clips and of connecting pieces according to different types, for fastening on connectors, on integrated circuit bases or on printed circuits etc., these different qualities bringing about an overall decrease in the production costs.

The contact piece 1, with the exception of clip 4, will be manufactured in a low-cost metal or alloy, for example brass or more particularly brass able to bear the crimping of a conductor in the portion of the contact piece 1 opposite that described in detail here above. The clip 4 will be manufactured preferably in an alloy of bronze and beryllium.

What is claimed is:

1. A contact piece for use with a corresponding male type element, comprising:

a portion having a female type end, and a lodging disposed axially in said portion for accommodating the corresponding male type element, said lodging including a contact clip for ensuring electrical contact between said corresponding male type element and the contact piece, said contact clip including a front extremity provided with a plurality of elastic contact fingers each finger, including a free extremity directed towards an opening of said lodging and a rear extremity in the form of an annular crown on which said contact fingers are fastened, said annular crown being fitted inside of a front part of said lodging.

2. Contact piece according to claim 1, wherein each of said fingers is inclined by an angle α relative to the longitudinal axis of said lodging.

3. Contact piece according to claim 2, wherein the angle α is comprised between 4° and 10°.

4. Contact piece according to claim 3, wherein the angle α is comprised between 6° and 8°.

5. Contact piece according to claim 1, wherein each finger comprises an arched portion near its free extremity, the edge of said free extremity moving away from the longitudinal axis of said housing.

6. Contact piece according to claim 1, wherein it further comprises an essentially tube-shaped bushing encircling the portion of the contact piece fitted with said contact clip, said bushing being provided with a front side comprising a passage opening coaxial to the longitudinal axis of the lodging.

7. Contact piece according to claim 6, wherein the bushing comprises a cylindrical rear portion fastened on a corresponding cylindrical neck of said contact piece.

8. Contact piece according to claim 6, wherein the passage opening has a diameter which allows a male element with a diameter equal or inferior to a determined diameter to engage and prevents a male element with a diameter greater than a determined diameter to engage in said portion of the contact piece of female type.

9. Contact piece according to claim 8, wherein the diameter of said lodging in its portion encircling said fingers is greater than the diameter circumscribed by said fingers when these are moved apart by a male element having said determined diameter has been mated in said contact piece.

10. Contact piece according to claim 8, wherein when a male element having said determined diameter or an inferior diameter is engaged between the fingers of the contact clip, no portion of the contact piece or of the bushing limits the moving apart of said fingers.

11. Contact piece according to claim 8, wherein when a male element having said determined diameter or an inferior diameter is engaged between the fingers of the contact clip, the moving apart of said fingers is an elastic movement.

12. Contact piece according to claim 8, wherein said passage opening and the arched portions of the elastic fingers constitute a guiding means of the male element during mating.

13. Contact piece according to claim 1, wherein said contact piece and the clip are manufactured in different materials.

14. Contact piece according to claim 13, wherein the contact piece is of brass.

15. Contact piece according to claim 14, wherein the contact piece is of a brass alloy able to bear crimping.

16. Contact piece according to claim 13, wherein the clip is of an alloy of bronze and beryllium.

17. Contact piece according to claim 1, wherein it complies with the norm MIL-C 39029.

18. Connector fitted with at least one contact piece according to claim 1.

19. Component base fitted with at least one contact piece according to claim 1.

20. Printed circuit board fitted with at least one contact piece according to claim 1.

* * * * *

US006264508C1

(12) INTER PARTES REEXAMINATION CERTIFICATE (484th)

United States Patent

Lehmann

(10) Number: US 6,264,508 C1

(45) Certificate Issued: Nov. 2, 2012

(54) FEMALE TYPE CONTACT PIECE ENABLING ELECTRICAL CONTACT WITH A MALE ELEMENT

(75) Inventor: Pierre Lehmann, Courcelon (CH)

(73) Assignee: Preci-Dip Durtal SA, Delemont (CH)

Reexamination Request:
No. 95/001,728, Aug. 26, 2011

Reexamination Certificate for:

| | |
|---|---|
| Patent No.: | **6,264,508** |
| Issued: | **Jul. 24, 2001** |
| Appl. No.: | **09/499,638** |
| Filed: | **Feb. 8, 2000** |

(30) Foreign Application Priority Data

Nov. 30, 1999 (EP) ..... 99811102

(51) Int. Cl.
*H01R 13/187* (2006.01)

(52) U.S. Cl. ..... 439/843

(58) Field of Classification Search ..... None
See application file for complete search history.

(56) References Cited

To view the complete listing of prior art documents cited during the proceeding for Reexamination Control Number 95/001,728, please refer to the USPTO's public Patent Application Information Retrieval (PAIR) system under the Display References tab.

*Primary Examiner* — Stephen Ralis

(57) ABSTRACT

The contact piece (1) comprises a portion of female type able to accommodate a corresponding portion of male type. This female type portion includes a contact clip (4) provided with elastic fingers (42) oriented towards the opening of a lodging (10) destined to accommodate said male type portion. The piece is completed with a bushing (5) encircling the clip and provided with a front side (50) comprising a passage opening (51) serving as gauge, accepting or refusing the passage of a male portion according to its diameter. In this manner, the elastic fingers (42) always operate in an elastic mode and never suffer a permanent deformation. Such a disposition has many other advantages.

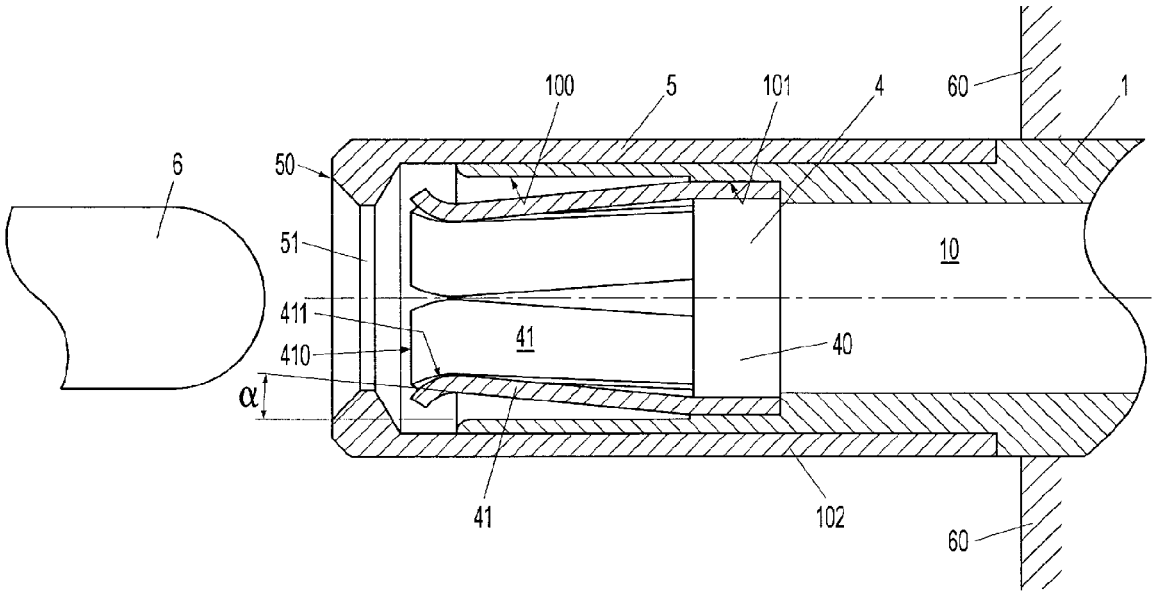

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-20 are cancelled.

New claims 21-25 are added and determined to be patentable.

*21. A female contact piece for use with a corresponding male type element comprising:*

*a substantially cylindrical extremity surrounding a longitudinally bored lodging for accommodating the corresponding male type element, the extremity extending along a longitudinal axis to a distal end; and*

*a separate contact clip partially disposed within the lodging for ensuring electrical contact between said corresponding male type element and the female contact piece, said contact clip including a front portion provided with a plurality of elastic contact fingers, each finger including a free end directed toward an opening of said lodging that extends beyond the distal end of the extremity, and a rear portion in the form of an annular crown on which said contact fingers are fastened, said annular crown being fitted inside of a front part of said lodging.*

*22. The female contact piece of claim 21, further comprising a third component in the form of an essentially tube-shaped bushing pressed over the distal end of the extremity.*

*23. The female contact piece of claim 22, wherein the third component comprises an end side positioned forward of the plurality of elastic contact fingers, the end side provided with a traversing opening coaxial with the longitudinal axis of the extremity and having a diameter less than the diameter of the distal end of the extremity.*

*24. The female contact piece of claim 22, wherein the third component extends over the extremity beyond the portion of the extremity wherein the rear of the contact clip is fitted, providing a mechanical reinforcement to help hold the contact clip in place within the extremity.*

*25. The female contact piece of claim 22, wherein the contact clip does not touch the third component even when a male type element in inserted into the lodging formed by the extremity.*

* * * * *